United States Patent [19]

Guppy et al.

[11] Patent Number: 4,718,264

[45] Date of Patent: Jan. 12, 1988

[54] LUBRICATION OF ROLLING MILLS

[75] Inventors: David W. Guppy, Broadstone; Neil Winkley, Bournemouth; Joseph L. Watson, Nursling Green, all of United Kingdom

[73] Assignee: Davy McKee (Poole) Limited, Poole, England

[21] Appl. No.: 871,376

[22] Filed: Jun. 6, 1986

[30] Foreign Application Priority Data

Jun. 10, 1985 [GB] United Kingdom ..... 8514598

[51] Int. Cl.[4] ..... B21B 27/10

[52] U.S. Cl. ..... 72/201; 72/236

[58] Field of Search ..... 72/45, 128, 200, 201, 72/202, 236

[56] References Cited

U.S. PATENT DOCUMENTS

| | | | |
|---|---|---|---|
| 3,913,369 | 10/1975 | Field et al. | 72/201 X |
| 4,061,010 | 12/1977 | Stock et al. | 72/201 |
| 4,272,976 | 6/1981 | Pizzedaz | 72/45 |
| 4,403,492 | 9/1983 | Hope | 72/201 |

FOREIGN PATENT DOCUMENTS

| | | | |
|---|---|---|---|
| 0056540 | 7/1982 | European Pat. Off. | 72/201 |
| 0114535 | 8/1984 | European Pat. Off. | 72/201 |
| 1433301 | 4/1976 | United Kingdom | 72/201 |

*Primary Examiner*—E. Michael Combs

*Attorney, Agent, or Firm*—Schwartz, Jeffery, Schwaab, Mack, Blumenthal & Evans

[57] ABSTRACT

A rolling mill comprises a plurality of rolls, means for directing liquid coolant onto the rolls at the ingoing side of the mill and a casing or casings enclosing the directing means. The casing or casings have contact seals engaging the rolls to prevent unwanted egress of coolant onto work entering the mill. The means for directing coolant onto the rolls are mounted on one or more fixed backing supports and inflatable sealing means are arranged between the casing or casings and the fixed backing support or supports. The arrangement enables the position of the casing or casings to adjust dependent on the roll diameters.

10 Claims, 8 Drawing Figures

LUBRICATION OF ROLLING MILLS

FIELD OF THE INVENTION

This invention relates to rolling mills used for rolling metal, such as aluminium strip.

BACKGROUND OF THE INVENTION

It is customary in rolling mills to apply a coolant to the rolls and/or the work to hold the temperature of the work within reasonable limits regardless of the heat generated during rolling. The coolant is usually water or is water-based. It has been customary to also include a rolling lubricant, for example in the form of an oil-water emulsion.

However, when water-based coolant contacts aluminium strip, it reacts with the aluminium to cause staining of the strip surface, which may inhibit the action of the rolling lubricant, even if applied separately from the coolant. The result is that the reduction effected in the mill is non-uniform across the strip width so that strip with poor flatness is produced. Further, the hardness of the stained areas differs from that of the remainder of strip and this difference causes unequal reduction in any subsequent rolling operation with further loss of flatness. Lastly, the appearance of the rolled material is marred.

To overcome these problems, European Patent Specification No. 0160381A proposes a method of rolling metal in a rolling mill in which liquid coolant is applied to a roll or rolls on the ingoing side of the mill within a casing or casings, unwanted egress of coolant from the casing or casings being prevented by the use of contact seals engaging the roll or rolls. Rolling lubricant is independently applied to the work and/or the back-up rolls at the ingoing side of the mill outside the casing or casings.

This method has several advantages. Thus, as the coolant is applied on the ingoing side of the mill in a casing or casings from which unwanted egress of coolant is effectively prevented, because of the direction of rotation of the rolls, there is minimal possibility of coolant being transferred through the bite between the work rolls and their back-up rolls and thence to the work at the outgoing side.

Secondly, contact seals are used, which are more effective than air seals in preventing escape of moisture. Their use is possible because the rolls at the ingoing side of the mill are at a reasonably low temperature and because the contact seals are lubricated by the coolant. No coolant mist is generated and there is no escape route for the mist even if it were generated. The contact seals further act as cleaners for the rolls and prevent particulate material being carried into the roll gap by the rolls and damaging the rolls and the work.

Thirdly, rolling lubricant is applied separately from the coolant at the ingoing side of the mill and outside the casing or casings. The separate application of rolling lubricant is essential because of the effectiveness of the contact seals, but, apart from that, it enables the lubricant to be distributed more evenly, makes possible better control of the lubricant, and can result in better efficiency of lubricant usage.

However, it will be appreciated that the use of contact seals between the rolls and the casing arrangement used requires the provision of contact seals across the faces of the rolls and also the provision of effective end seals at the ends of the rolls. The end seals must provide effective contact with both a work roll and its associated back-up roll extending over the region of the nip between the two rolls. The relative diameters and thus the conformation of the nip between the work roll and back-up roll can vary, especially as a result of grinding of the rolls for maintenance purposes.

The end seals and, to a lesser extent, the face seals must therefore be capable of accommodation to varying roll diameters.

OBJECTS OF THE INVENTION

It is an object of the present invention to provide a rolling mill having a casing or casings as described above wherein at least the end contact seals and preferably also the face seals between the casing or casings and the rolls are capable of maintaining an adequate seal over a range of roll diameters. Other objects of the invention will become apparent from the following description and claims.

SUMMARY OF THE INVENTION

According to this invention we provide a rolling mill comprising a plurality of rolls, means for directing liquid coolant on to the rolls at the ingoing side of the mill mounted on one or more fixed backing supports, a casing or casings enclosing the directing means and having contact seals engaging the rolls to prevent unwanted egress of coolant from the casing or casings onto work entering the mill and inflatable sealing means between the casing or casings and the fixed backing support or supports whereby the position of the casing or casings can be adjusted dependent on the diameters of the rolls.

DESCRIPTION OF THE PREFERRED EMBODIMENTS

Preferably the inflatable sealing means comprises a pneumatically operated inflatable ring seal between the or each fixed backing support and the or each casing. Preferably the contact seals comprise face seals extending substantially across the entire width of the rolls in contact therewith and these face seals are preferably provided with inflatable means for urging the seals into contact with the rolls.

A preferred type of rolling mill comprises a pair of work rolls each having an associated back-up roll, with a separate casing being provided for each work roll having contact seals adapted to engage the work roll and its associated back-up roll. Preferably the casings are provided with end pieces shaped to generally conform to portions of the surfaces of the adjacent work and back-up rolls and the nip therebetween, which end pieces are provided with contact seals engaging the rolls, suitably provided with inflatable means for urging the seals into contact with the rolls. The contact seals may be directly supplied with a lubricant.

An additional optional feature of the invention is the provision of a roll nip sealing member adapted to contact and extend across the width of a work roll and associated back-up roll adjacent the nip therebetween. The sealing member suitably comprises support means extending from the associated casing and a contact strip of deformable material (such as polyurethane) mounted thereon.

The invention will now be described by way of example with reference to the accompanying drawings.

Figure 1:
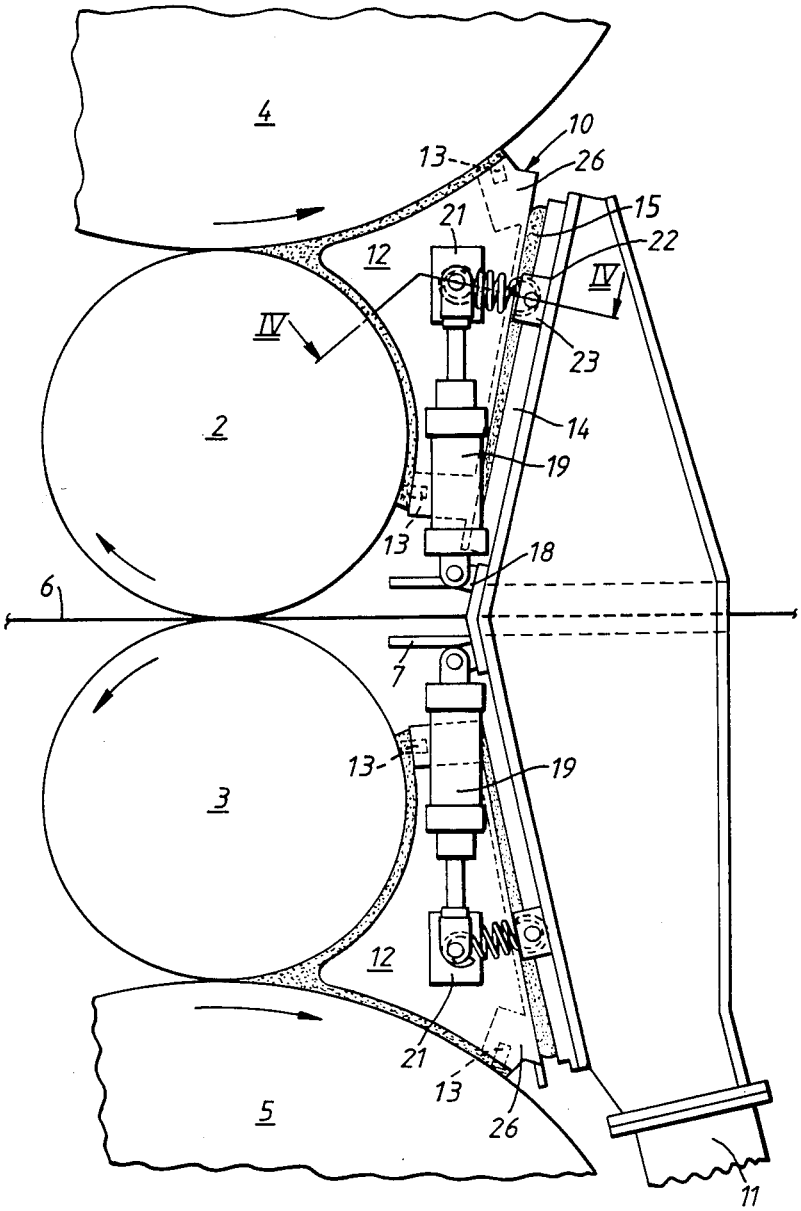
FIG. 1 is a side elevation of a rolling mill in accordance with the invention.
Figure 2:
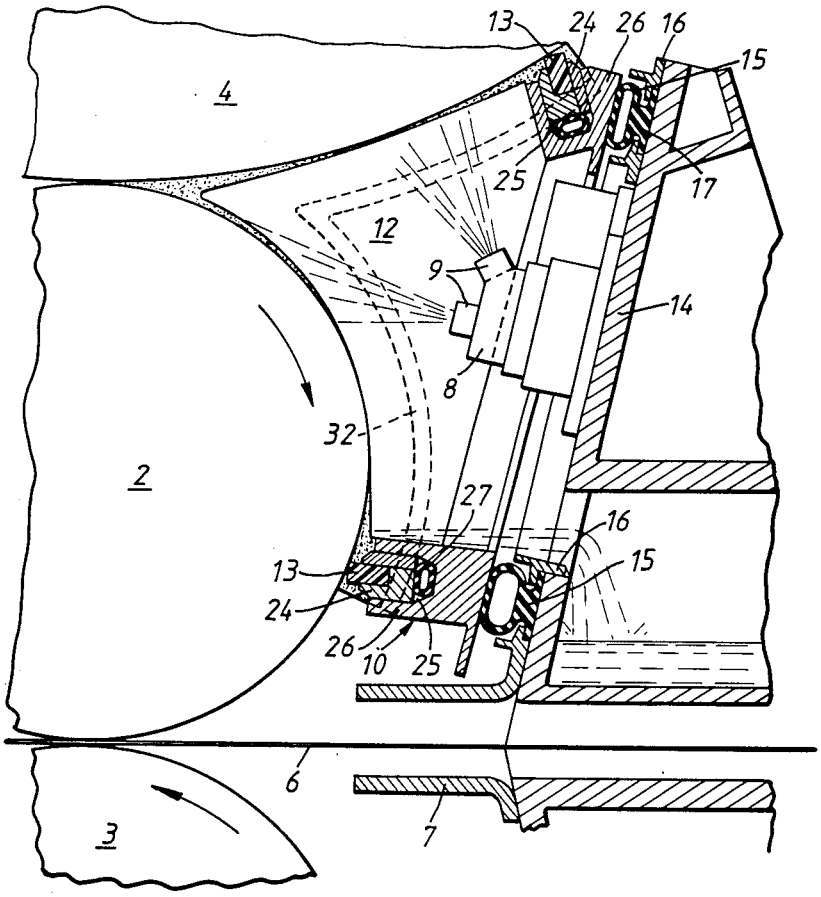
FIG. 2 and 3 are sections through the upper portion of the rolling mill shown in FIG. 1 but illustrating the use of rolls of differing relative diameter.
Figure 3:
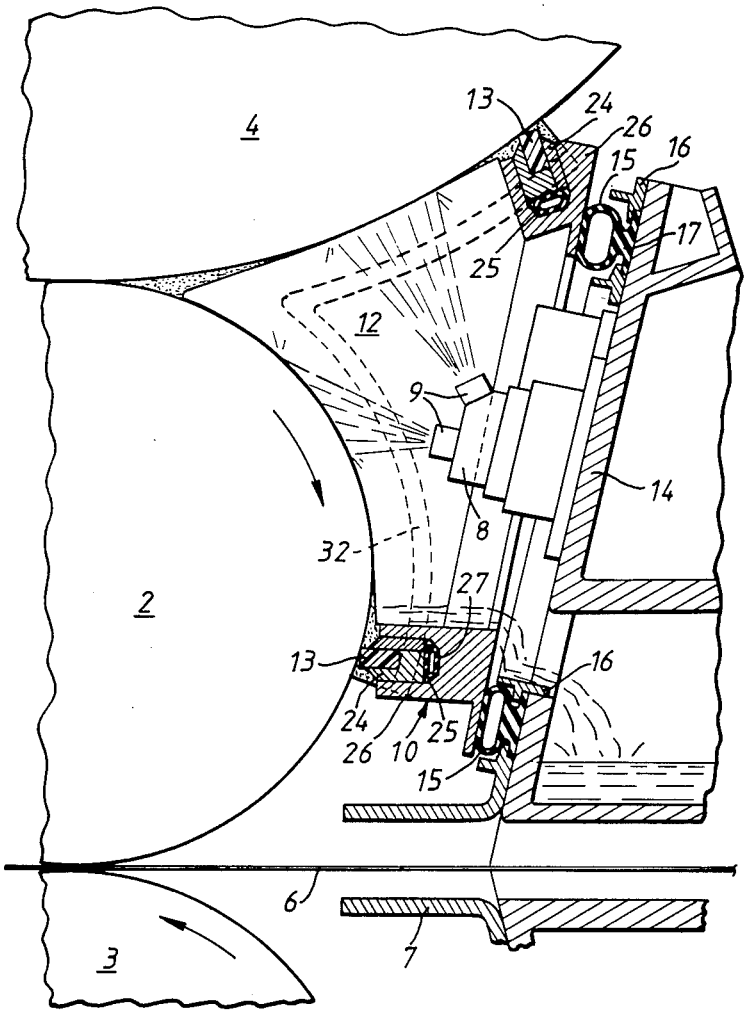

As shown in FIG. 1, the rolling mill has upper and lower work rolls 2 and 3 respectively and upper and lower back-up rolls 4 and 5 respectively. The work, for example, aluminium strip, is indicated at 6, the direction of movement of the work being from right to left and the strip passing through a guide 7 to the roll gap. Coolant is applied to the rolls at the ingoing side of the mill, i.e. at the right-hand side of the rolls in the drawings; spray bars, one of which is shown at 8 in FIGS. 2 and 3, are located respectively above and below the pass line and extend the full width of the rolls and have, at closely spaced intervals, sets of spray nozzles 9 directed at the work rolls, the back-up rolls and the nips therebetween. The spray bars are preferably as described in European Patent Specifications Nos. 0041863B and 0153532A. Each spray bar 8 is located with an enclosed sealing chamber 10 which contains totally the coolant discharged by the nozzles 9 and prohibits the egress of coolant onto the strip 6. Used coolant is withdrawn from the chambers via discharge outlet 11, upper and lower chambers being interconnected for this purpose by any suitable means.

The enclosed chambers 10 which prevent egress of coolant are defined by casings formed by end plates 12, face seals 13, top and bottom edge portions 26 and fixed backing supports 13 mounted on guide 7, or in any other convenient way, adjacent the mill rolls.

Figure 4:
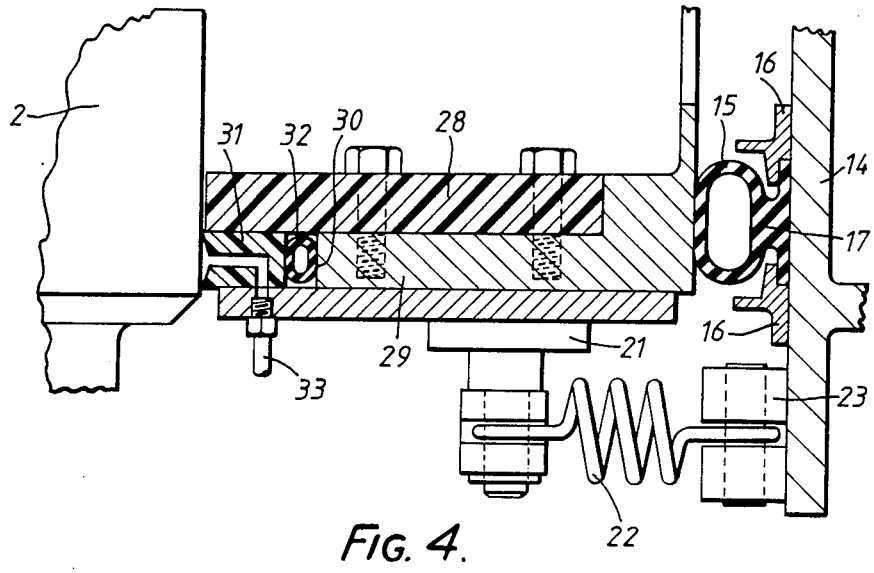
FIG. 4 is a cross section on the line IV—IV of FIG. 1.

Backing supports 14 carry around their edges inflatable ring seals 15, of cross section best seen in FIGS. 2, 3 and 4, clamped in position by retaining members 16 which define a channel to receive a T-section projection 17 on seals 15. Seals 15 are connected to an air supply valve and inflated prior to operation of the spray bars 8 so as to bear on edge portions 26 and end plates 12 of the adjacent casing. Backing supports 14 also pivotably support, via brackets 18, one end of a pair of piston and cylinder arrangements 19, the piston rods of which are connected to pivot blocks 21 on the end plates 12. Springs 22 act between pivot blocks 21 and anchor blocks 23 mounted on supports 14.

The combination of piston and cylinder arrangements 19 with ring seals 15 means that, if the roll diameters are changed, for example as a result of roll regrinding, the end plates 12 and face seals 13 will continue to be urged towards the rolls but will continue to make water-tight sealing engagement with support 14 under the spring biassing action.

Face seals 13 are provided to engage the surface of each of work rolls 2 and 3 and back-up rolls 4 and 5. As shown in FIGS. 2 and 3, each face seal is mounted in a carrier block 24, itself located in a groove 25 provided in the edge portion 26 of the sealing chamber. To exert pressure on the seals 13 and ensure adequate sealing contact with the adjacent roll face, inflatable tubes 27 are located in the grooves 25 and, under control of a valve supplying pressurised air to tubes 27, the seals 13 can be moved into contact with the rolls.

The formation of end plates 12 is best seen in FIGS. 2, 3 and 4. These end plates 12 comprise a support plate 28, preferably made of a phenolic resin laminate marketed under the trade mark "Tufnol", shaped as shown in FIGS. 2 and 3 to substantially conform to the shape of the bite between the work and back-up rolls, although, as the shape of the bite will vary with roll diameter, the shape of support plates 28 is not exact and the plates themselves are not in contact with the rolls. Instead the support plates 28 are bolted to facing plates 29 leaving a groove 30 between plates 28 and 29 in the region of the roll face for the insertion of a resilient contact end seal 31 formed of a moulded elastomer spaced from the base of the groove to allow interposition of an inflatable tube 32 which can be supplied with compressed air to force the seal 31 against the adjacent roll face. The seal 31 may be supplied with lubricant on supply line 33 if desired, preferably in the form of an oil mist.

Figure 5:
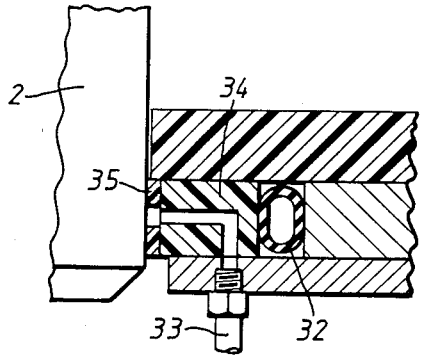
FIGS. 5 and 6 are scrap sections, similar to FIG. 4, but illustrating alternative sealing members.
Figure 6:
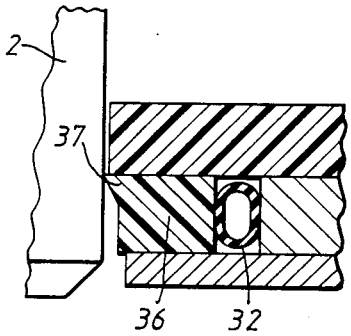

FIGS. 5 and 6 show alternative seal arrangements. In FIG. 5, seal 31 of FIG. 4 is replaced by a seal in the form of a resilient elastomeric block 34 faced with a contact surface 35 for example of ptfe. Again, a lubricant oil mist may be supplied on line 33. FIG. 6 shows the provision of a shaped resilient seal 36 having a single contact lip 37 in contrast to the double lip arrangement shown in FIG. 4.

It will be appreciated that additional sealing means may be optionally employed in the region of the nips between the work and back-up rolls. Thus although contact between the work rolls and associated back-up rolls is usually sufficient to prevent any escape of coolant between the rolls, it has been found that at certain times during the operation of the rolling mill the rolls can become distorted and create a small gap or gaps between the rolls. This can occur, for example, when changes take place in the operating conditions, such as when the material to be rolled is of a different size, or when the rolls are changed. It may also occur at the start of a working shift, until the mill has settled into its working condition.

Figure 7:
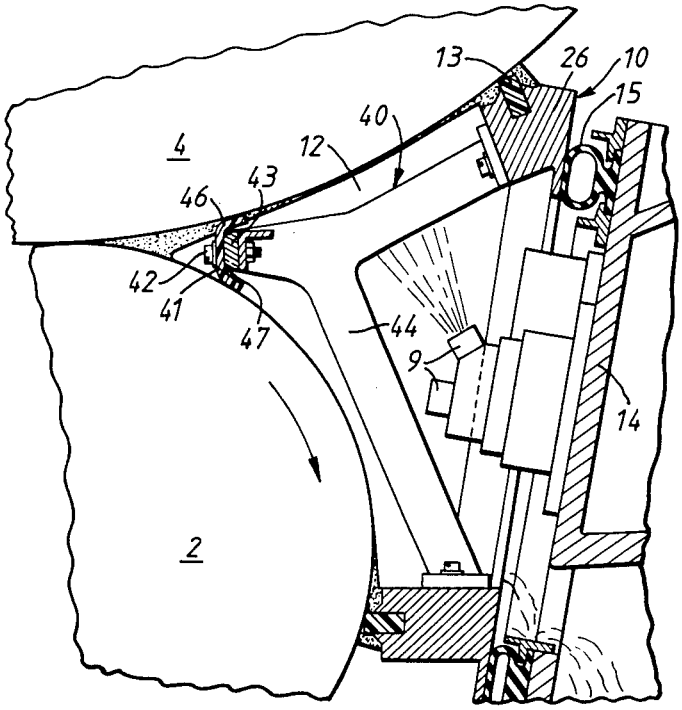
FIG. 7 is a section similar to FIG. 3 but showing the use of a roll nip seal.
Figure 8:
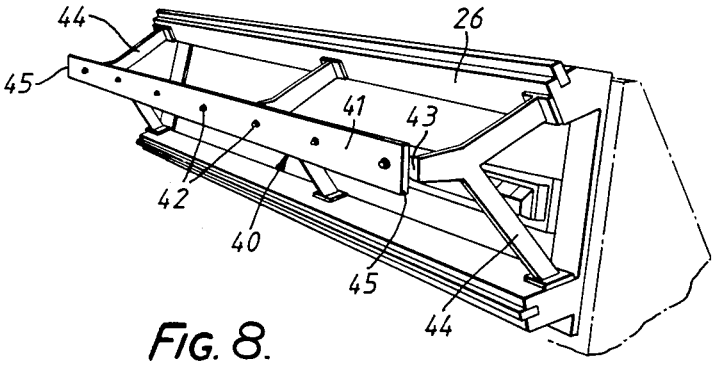
FIG. 8 is a perspective view of the roll nip seal of FIG. 7.

FIGS. 7 and 8 illustrate the provision of a suitable roll nip sealing member generally indicated at 40. Sealing member 40 comprises a strip 41 of material such as polyurethane which is secured by screws 42 to a support bar 43, spaced by Y-shaped brackets 44 from edge portions 26 of sealing chamber 10. The strip 41 extends the width of the chamber 10 and end faces 45 of the strip 41 are in sealing engagement with end plates 12 of the chamber 10. The strip 41 is secured to the support bar 43 at intervals along its length which enables the strip to be replaced when necessary. As seen in FIG. 7 the strip 41 extends above and below the support bar 43 to provide flexible portions 46 which will conform to the surface of the work roll 2 and the back-up roll 4 when the assembly engages the rolls, as seen in FIG. 7. The dimensions of the flexible portions 46 are such that the normal variations that occur in roll diameter, due to grinding, can be accommodated without any adjustment of the strip. The support bar 43 has rounded corners 47 to provide a compatible shape around which the strip 41 may conform, when in the operative condition.

We claim:

1. A rolling mill comprising:

a plurality of mill rolls;

means for directing liquid coolant onto the rolls at the ingoing side of the mill:

one or more fixed backing supports on which are mounted the coolant directing means;

a casing or casings enclosing the coolant directing means and having contact seals engaging the rolls to prevent unwanted egress of coolant from the casing or casings onto work entering the mill; and inflatable sealing means between the casing or casings and the fixed backing support or supports, whereby the position of the casing or casings can be adjusted dependent on the diameters of the rolls.

2. A rolling mill according to claim 1, wherein the inflatable sealing means comprises a pneumatically operated inflatable ring seal between the or each fixed backing support and the or each casing.

3. A rolling mill according to claim 1, wherein the contact seals comprise face seals extending substantially across the entire width of the rolls in contact therewith, which face seals are provided with inflatable means for urging the seals into contact with the rolls.

4. A rolling mill comprising:

a pair of work rolls;

a back-up roll associated with each work roll, and, for each work roll and associated back-up roll;

means for directing liquid coolant onto the work roll and back-up roll at the ingoing side of the mill;

a fixed backing support on which is mounted the coolant directing means;

a casing enclosing the coolant directing means and having contact seals engaging the work roll and back-up roll to prevent unwanted egress of coolant from the casing onto work entering the mill; and inflatable sealing means between the casing and the fixed backing support, whereby the position of the casing can be adjusted dependent on the diameters of the work roll and back-up roll.

5. A rolling mill according to claim 4, wherein the casings are provided with end pieces shaped to generally conform to portions of the surfaces of the adjacent work and back-up rolls and the nip therebetween, which end pieces are provided with contact seals engaging the rolls.

6. A rolling mill according to claim 5, wherein the contact seals of the end pieces are provided with inflatable means for urging the seals into contact with the rolls.

7. A rolling mill according to claim 5, wherein the contact seals of the end pieces are directly supplied with a lubricant.

8. A rolling mill according to claim 5 wherein at least one roll nip sealing member is provided adapted to contact and extend across the width of a work roll and associated back-up roll adjacent the nip therebetween.

9. A rolling mill according to claim 8, wherein the sealing member comprises support means extending from the associated casing and a contact strip of deformable material mounted thereon.

10. A rolling mill according to claim 4, wherein the inflatable sealing means comprises a pneumatically operated inflatable ring seal between the backing support and the casing.

* * * * *